US008180087B2

(12) United States Patent
Wu

(10) Patent No.: US 8,180,087 B2
(45) Date of Patent: May 15, 2012

(54) MICROPHONE HAVING A THREE-PIN SOCKET AND A USB SOCKET

(76) Inventor: Ying Jui Wu, Taipei (TW)

( * ) Notice: Subject to any disclaimer, the term of this patent is extended or adjusted under 35 U.S.C. 154(b) by 746 days.

(21) Appl. No.: 12/342,075

(22) Filed: Dec. 23, 2008

(65) Prior Publication Data

US 2010/0061559 A1 Mar. 11, 2010

(30) Foreign Application Priority Data

Sep. 5, 2008 (CN) ..... 2008 1 0216049

(51) Int. Cl.
*H04R 9/08* (2006.01)

(52) U.S. Cl. ..... 381/355; 381/92; 381/122; 381/174; 381/189; 381/360; 381/361; 381/362; 381/369; 439/527; 439/540.1

(58) Field of Classification Search ..... 381/355, 381/394, 92, 122, 174, 189, 360, 361, 362, 381/369; 439/540.1, 527
See application file for complete search history.

(56) References Cited

U.S. PATENT DOCUMENTS 7,715,874 B2 * 5/2010 Bjorklund ..... 455/557

FOREIGN PATENT DOCUMENTS

DE 202006002942 U1 * 8/2007
JP 2007-220051 * 8/2007
WO WO 2005/048257 * 5/2005

OTHER PUBLICATIONS

Derwen 2007-779689, Aug. 2007, DE, Brauner.*

* cited by examiner

*Primary Examiner* — Long Tran

(57) ABSTRACT

A microphone comprises a three-pin socket, a first USB socket and a USB adapter. The first USB socket is fixed within the three-pin socket. The three-pin socket comprises an inserted block and three pins. The three pins are fixed on the inserted block. The first USB socket is embedded in the inserted block. The USB adapter comprises a USB plug which matches the first USB socket and a second USB socket which has a different dimension from the first USB socket. The USB plug and the second USB socket are connected electrically. The microphone can be normally used at all occasions. The dimension of the finished product is reduced so as to save a very large space. The microphone can be electrically connected with a USB data line with a USB plug having a different dimension from the first USB socket.

3 Claims, 6 Drawing Sheets

MICROPHONE HAVING A THREE-PIN SOCKET AND A USB SOCKET

BACKGROUND OF THE INVENTION

The present invention relates to a kind of microphone, in particular to a microphone having a three-pin socket and a USB socket.

With progress of technology and improvements of people's living conditions, various high-tech products are widely used more and more. For example, all kinds of microphones are used in a meeting room or other business occasions. We have designed a lot of different microphones to meet those requirements.

In the current market, some microphones have a three-pin socket to connect a three-hole signal line, so that they are usually used in an ordinary acoustics or at a professional vocal concert etc. Other microphones have a USB socket to connect a USB data line, so that they are usually used in a computer or a digital product etc. There exist obvious differences between the standard of the three-pin socket and the standard of a USB data line, so is between the USB socket and the three-hole signal line. Those differences shall make the microphone fail to use normally at many occasions, for examples, the microphone only having a three-pin socket cannot match a USB data line, in the same way, the microphone only having a USB socket cannot match a three-hole signal line.

Accordingly, it is necessary and applicable to produce a microphone which can match both a three-hole signal line and a USB data line.

BRIEF SUMMARY OF THE INVENTION

The object of the present invention is to provide a microphone having a three-pin socket and a USB socket in order to match both a three-hole signal line and a USB data line.

The present invention indicates a technical solution to achieve the object: a microphone comprises a three-pin socket and a first USB socket. Said first USB socket is fixed within said three-pin socket.

The further improvement of the technical solution is: the three-pin socket comprises an inserted block and three pins, and the three pins are fixed on the inserted block, and the first USB socket is embedded in the inserted block.

The further improvement of the technical solution is: the microphone furtherly comprises a USB adapter, and the USB adapter comprises a USB plug which matches the first USB socket and a second USB socket which has a different dimension from the first USB socket, and the USB plug and the second USB socket are connected electrically.

The further improvement of the technical solution is: the microphone furtherly comprises a PCB board which is fixed between the three pins of the three-pin socket and the first USB socket, and the three-pin socket and the first USB socket are respectively fixed on the two opposite surfaces of the PCB board.

The further improvement of the technical solution is: the microphone furtherly comprises a microphone casing, and the three-pin socket is fixed at the back end of the inner chamber of the microphone casing, and the inserted block is fixed at the back end of the inner chamber of the microphone casing.

The microphone in accordance with the present invention has many advantages than prior arts. The microphone has a three-pin socket and a USB socket in order to respectively connect a three-hole signal line and a USB data line, so the microphone can be normally used at all occasions. The USB socket is fixed within the three-pin socket, so the dimension of the microphone casing is reduced, and the dimension of the finished product is reduced so as to save a very large space. The microphone furtherly comprises a USB adapter which can make the microphone electrically connect the USB plug having a different dimension from the first USB socket, when the USB plug of a USB data line has a different dimension from the first USB socket of the microphone.

DETAILED DESCRIPTION OF THE INVENTION

Figure 1:
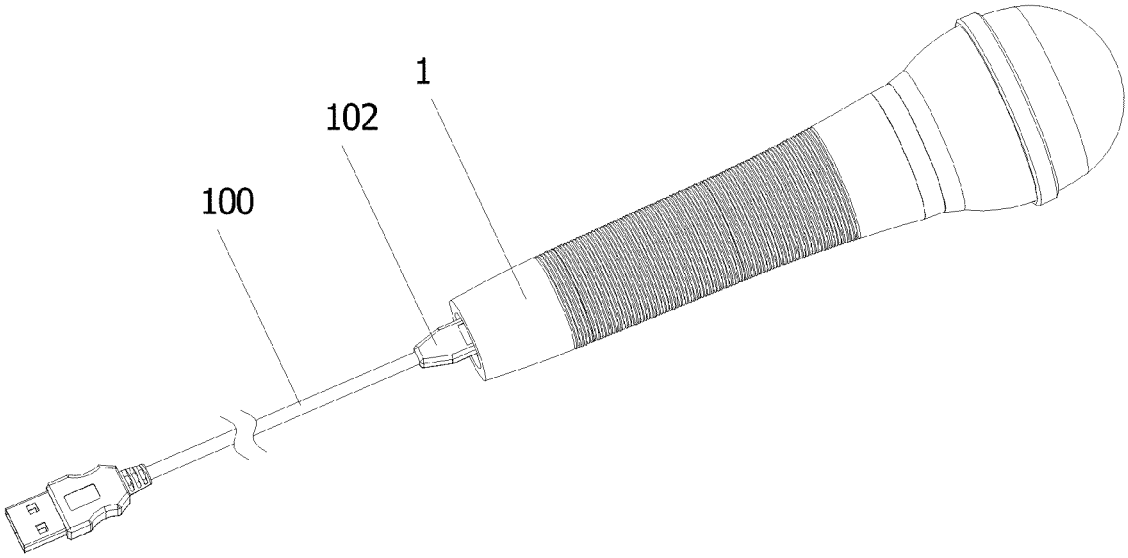
FIG. 1 is an assembled solid view of the first embodiment of the microphone in accordance with the present invention.
Figure 2:
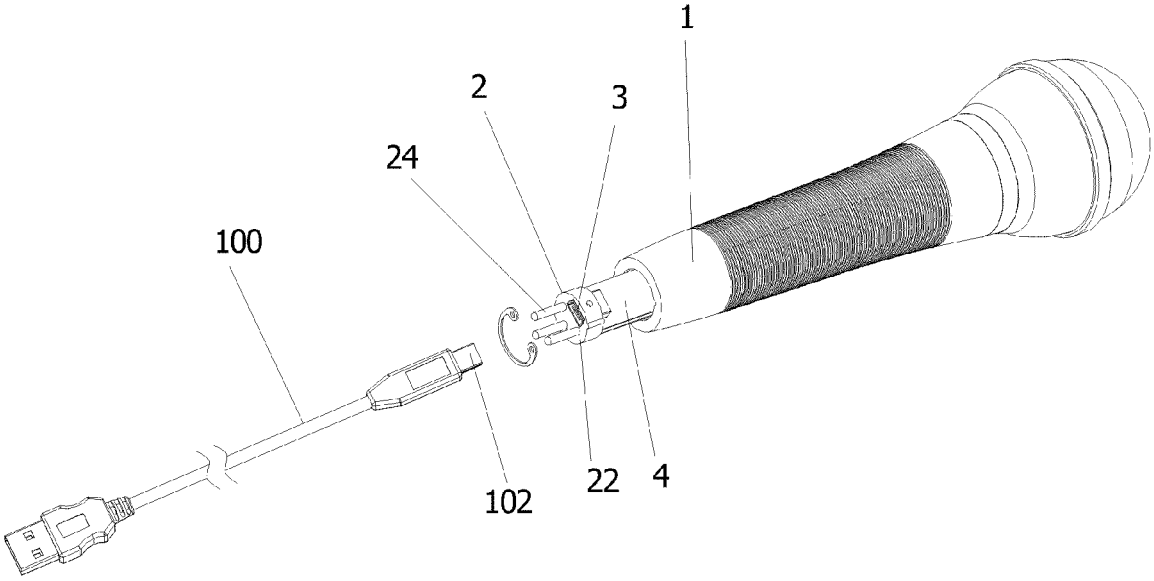
FIG. 2 is an exploded solid view of the first embodiment of the microphone in accordance with the present invention.
Figure 3:
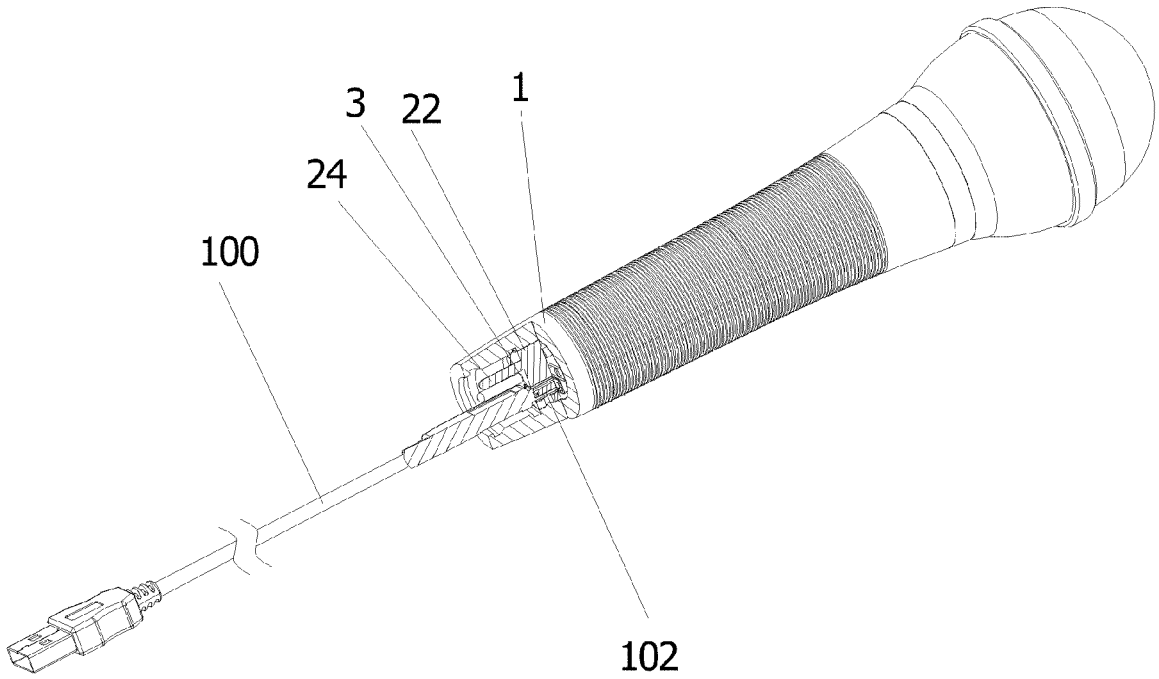
FIG. 3 is a partial cutaway view of the first embodiment of the microphone in accordance with the present invention.

As shown in FIG. 1 to FIG. 3, the first embodiment of the microphone in accordance with the present invention comprises a microphone casing 1, a three-pin socket 2, a first USB socket 3 and a PCB board 4.

The microphone casing 1 is a hollowly cylindraceous.

The three-pin socket 2 is fixed at the back end of the inner chamber of the microphone casing 1. The three-pin socket 2 comprises an inserted block 22 and three pins 24. The inserted block 22 is fixed at the back end of the inner chamber of the microphone casing 1. The three pins 24 are fixed on the inserted block 22 and surround to form a triangular position.

The first USB socket 3 is fixed within the three-pin socket 2. The first USB socket 3 is embedded in the inserted block 22 of the three-pin socket 2.

The PCB board 4 is fixed between the three pins 24 of the three-pin socket 2 and the first USB socket 3. The three-pin socket 2 and the first USB socket 3 are respectively fixed on the two opposite surfaces of the PCB board 4. The PCB board 4 insulatingly separates the electric circuit components (not shown in figs) of the three-pin socket 2 and the first USB socket 3 in order to prevent noises and reinforce structural stability.

In the finished product manufactured in accordance with the present invention, the three-pin socket 2 and the first USB socket 3 both comply with the related national standard and international standard, and the first USB socket 3 has the same dimension as the existed USB socket in the current market, but the distal portion of the first USB socket 3 is thinner than that of the existed USB socket in the current market.

When we use the microphone, if we only have a three-hole signal line (not shown in figs), we can insert the three-hole signal line into the three-pin socket 2 in order to connect electrically. If we only have a USB data line 100 and the USB plug 102 of the USB data line 100 has the same dimension as the first USB socket 3, we can insert the USB plug 102 into the first USB socket 3 in order to connect electrically.

In the first embodiment, the microphone comprises a three-pin socket 2 and a USB socket 3 in order to match not only a three-hole signal line but also a USB data line 100, so the microphone can be normally used at all occasions. The first USB socket 3 is fixed within the three-pin socket 2, so the dimension of the microphone casing 1 is reduced, so that the dimension of the finished product is reduced so as to save a very large space.

Figure 4:
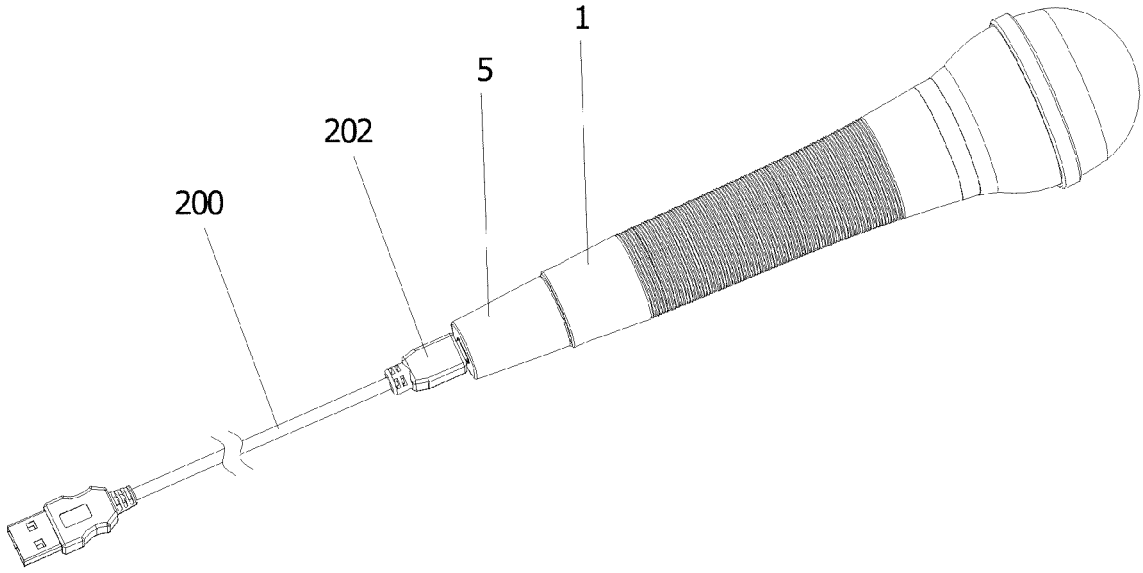
FIG. 4 is an assembled solid view of the second embodiment of the microphone in accordance with the present invention.
Figure 5:
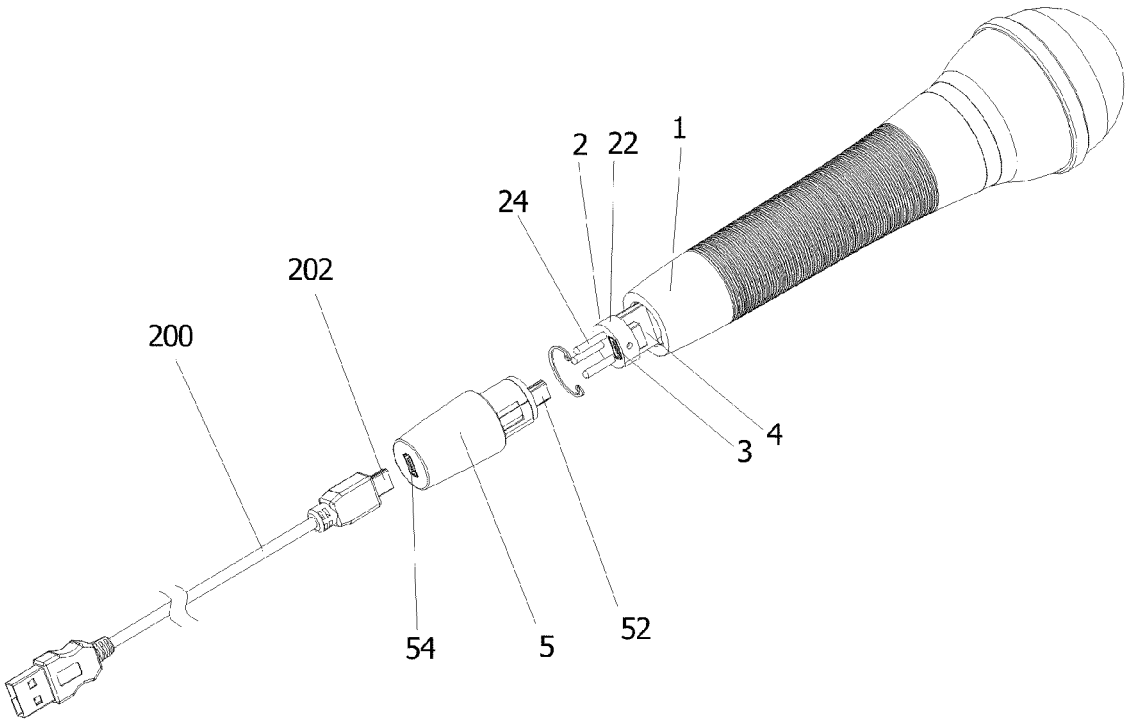
FIG. 5 is an exploded solid view of the second embodiment of the microphone in accordance with the present invention.
Figure 6:
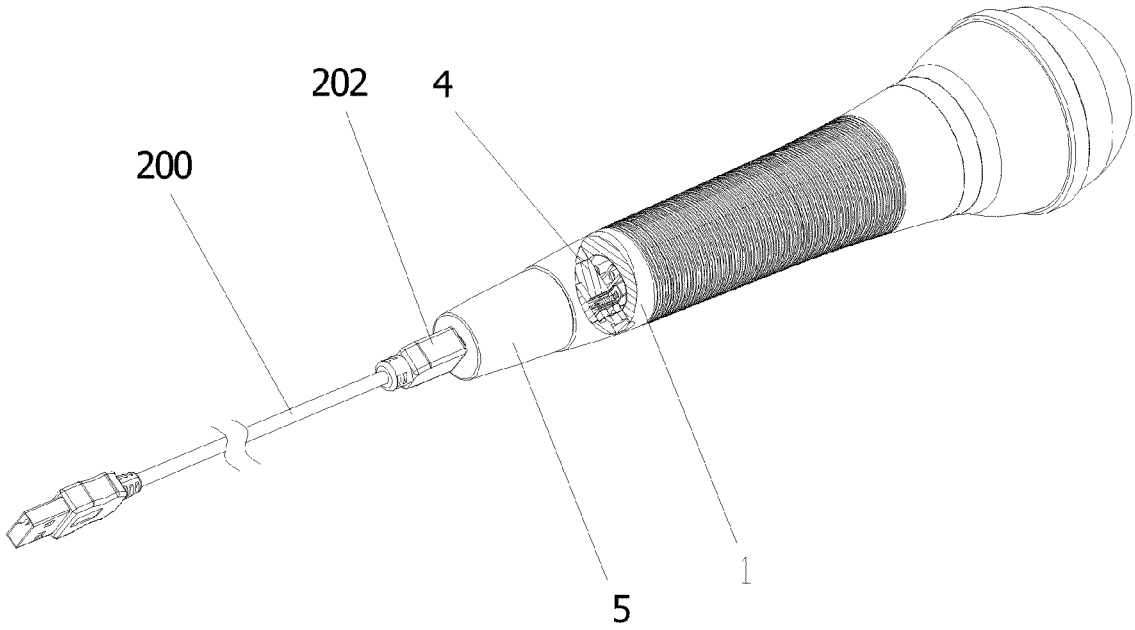
FIG. 6 is a partial cutaway view of the second embodiment of the microphone in accordance with the present invention.

As shown in FIG. 4 to FIG. 6, the second embodiment of the microphone in accordance with the present invention not only comprises a microphone casing 1, a three-pin socket 2, a first USB socket 3 and a PCB board 4 which are the same as those described in the first embodiment, but also comprises a USB adapter 5.

The USB adapter 5 comprises a USB plug 52 which matches the first USB socket 3 and a second USB socket 54 which has a different dimension from the first USB socket 3. The USB plug 52 and the second USB socket 54 are connected electrically. When the USB plug 202 of a USB data line 200 has a different dimension from the first USB socket 3 but has the same dimension as the second USB socket 54, we can use the USB adapter 5 to connect the first USB socket 3 of the microphone and the USB plug 202 of the USB data line 200.

When we use the microphone, if we only have a three-hole signal line (not shown in figs), we can directly insert the three-hole signal line into the three-pin socket 2 in order to connect electrically.

When we use the microphone, if we only have a USB data line 200 and the USB data line 200 has a USB plug 202 which has a different dimension from the first USB socket 3 but has the same dimension as the second USB socket 54, we can insert the USB plug 52 into the first USB socket 3 to match stably, then insert the USB plug 202 into the second USB socket 54, so that the microphone and the USB data line 200 are connected electrically.

In the second embodiment, the microphone comprises a three-pin socket 2 and a USB socket 3 in order to match not only a three-hole signal line but also a USB data line 100, so the microphone can be normally used at all occasions. The first USB socket 3 is fixed within the three-pin socket 2, so the dimension of the microphone casing 1 is reduced, so that the dimension of the finished product is reduced so as to save a very large space. Furthermore, the microphone comprises a USB adapter 5, when the USB plug 202 of the USB data line 200 has a different dimension from the first USB socket 3, the adapter 5 can aid the microphone to connect electrically with the USB plug 202.

In said two embodiments, the microphone casing 1 is traditionally cylindraceous. We shall realize that the shape of the microphone casing 1 can be easily changed to a different shape in another embodiment. The embodiments with different shapes of the microphone casing 1 also can carry out said technical solution of the present invention and get the same or similar technical effects.

I claim:

1. A microphone comprising: a three-pin socket and a first USB socket, said first USB socket being fixed within said three-pin socket;

wherein the microphone furtherly comprises a USB adapter, and the USB adapter comprises a USB plug which matches the first USB socket and a second USB socket which has a different dimension from the first USB socket, and the USB plug and the second USB socket are connected electrically.

2. A microphone according to claim 1, wherein the three-pin socket comprises an inserted block and three pins, and the three pins are fixed on the inserted block, and the first USB socket is embedded in the inserted block.

3. A microphone according to claim 2, wherein the microphone furtherly comprises a PCB board which is fixed between the three pins of the three-pin socket and the first USB socket, and the three-pin socket and the first USB socket are respectively fixed on the two opposite surfaces of the PCB board.

* * * * *